United States Patent [19]

Eith

[11] Patent Number: 4,537,354

[45] Date of Patent: Aug. 27, 1985

[54] ORIFICE VALVE FOR AN ULTRASONIC LIQUID ATOMIZER

[75] Inventor: Gerhard Eith, Munich, Fed. Rep. of Germany

[73] Assignee: Siemens Aktiengesellschaft, Berlin & Munich, Fed. Rep. of Germany

[21] Appl. No.: 470,958

[22] Filed: Mar. 1, 1983

[30] Foreign Application Priority Data

Mar. 12, 1982 [DE] Fed. Rep. of Germany ..... 3209139

[51] Int. Cl.[3] ..... B05B 3/14

[52] U.S. Cl. ..... 239/102; 239/506

[58] Field of Search ..... 239/102, 4, 453, 456, 239/459, 505, 506, 576

[56] References Cited

U.S. PATENT DOCUMENTS

| | | | |
|---|---|---|---|
| 2,695,069 | 11/1954 | Boerner | 239/456 X |
| 2,855,244 | 10/1953 | Camp | 299/1 |
| 2,966,311 | 12/1960 | Davis | 239/576 X |
| 3,765,606 | 10/1973 | Moss et al. | 239/102 |
| 3,958,760 | 5/1976 | Rosenberg | 239/453 |

FOREIGN PATENT DOCUMENTS

| | | | |
|---|---|---|---|
| 36617 | 9/1981 | European Pat. Off. | 239/102 |
| 2029207 | 12/1971 | Fed. Rep. of Germany . | |
| 2112984 | 9/1972 | Fed. Rep. of Germany . | |
| 2308584 | 2/1980 | Fed. Rep. of Germany . | |

*Primary Examiner*—Andres Kashnikow
*Assistant Examiner*—Daniel R. Edelbrock
*Attorney, Agent, or Firm*—Hill, Van Santen, Steadman & Simpson

[57] ABSTRACT

An ultrasonic liquid atomizer with an orifice valve has an ultrasonic oscillator with an atomizer plate. An axial bore for liquid supply onto a surface of the atomizer plate is provided together with an impact body for deflecting and distributing supplied liquid on the atomizer plate. The impact body has a stem situated in the axial bore of the oscillator and of the atomizer plate, the impact body being approximately centered over the bore. The stem of the impact body is continued in the form of a retaining wire extending beyond the oscillator at the side opposite the atomizer plate. An end of the retaining wire opposite the stem is secured to a component for executing the motion of the impact body relative to the atomizer plate such that an orifice opening at the surface of the atomizer plate between the atomizer plate and impact body can be closed via the retaining wire and the stem of the impact body.

7 Claims, 2 Drawing Figures

ORIFICE VALVE FOR AN ULTRASONIC LIQUID ATOMIZER

BACKGROUND OF THE INVENTION

The present invention relates to an orifice valve for an ultrasonic liquid atomizer as described in German Patent Application No. 3036721, published Apr. 8, 1982, incorporated herein by reference. Such an ultrasonic liquid atomizer comprises an ultrasonic oscillator with a work plate, an axial bore for liquid supply to a surface of the work plate, and an impact body which serves for the deflection and distribution of the supplied liquid on the work plate. In such a liquid atomizer the impact body has a stem which is situated in the axial bore of the oscillator under the work plate and which exhibits a centering in the bore at least in that area of the axial bore which is situated close to the discharge opening of the bore. Given this liquid atomizer, the stem of the impact body is continued by a retaining wire which is secured outside of the oscillator in a region of said oscillator lying opposite the work plate. Given such a liquid atomizer, the retaining wire extends out of the end of the oscillator opposite the impact body.

In this liquid atomizer, the stem preferably has a shape with more than two edges and, in particular, is designed with star-like cross-section, a centering of the stem in the bore being thus achieved. The head of the impact body is preferably designed mushroom-like with a convex exterior surface and its lower face facing the surface of the atomizer plate has an outer edge which has a radial dimension greater than a corresponding dimension radius of the bore in the atomizer plate.

An ultrasonic liquid atomizer (according to the aforementioned patent) as described above has proven itself for atomizing liquids, particularly volatile oils and solutions of medications, cosmetics and insecticides. In contrast to water, however, additional difficulties arise when atomizing liquids (such as cited above by way of example) when the atomization is temporarily interrupted. During the idle times, a thickening, encrustation and/or sticking of the discharge opening provided in the atomizer plate for the liquid can occur, particularly due to evaporation, depending upon the type of liquid or solvent.

A resolution of this problem could be to retract the supplied liquid upon termination of the atomization operation so that the discharge opening remains free of such a fluid during its idle time. Such a technique, however, is very involved and may not be practical, particularly given atomization of medication because foreign materials could also be trapped with the retraction into the discharge opening.

SUMMARY OF THE INVENTION

It is an object of the present invention to specify an improvement for an ultrasonic liquid atomizer with which the aforementioned difficulties can be eliminated.

Given an ultrasonic liquid atomizer having an ultrasonic oscillator with an atomizer plate, axial bore means in the oscillator and atomizer plate for liquid supply onto a surface of the atomizer plate, an impact body means is provided for deflecting and distributing supplied liquid on the atomizer plate. The impact body means has a stem which is situated in the axial bore means of the oscillator and of the atomizer plate, and the impact body means is approximately centered over the bore. The stem of the impact body means is continued in the form of a retaining wire extending beyond the oscillator and a side opposite the atomizer plate. An end of the retaining wire opposite the stem is secured to a component means for executing a motion of the impact body means relative to the atomizer plate such that an orifice opening at the surface of the atomizer plate between the atomizer plate and impact body means can be closed via the retaining wire and the stem of the impact body means.

The present invention proceeds from the perception that in the aforementioned German Patent the impact body of the atomizer, which is extremely advantageous per se for the atomization, promotes the occurrence of undesired encrustation and/or sticking, and/or prevents that a partial encrustation or a partial sticking of the discharge opening again is eliminated by itself when resumption of operation takes place, i.e., when fluid again is supplied or fed. It is suspected that this is related to the otherwise very advantageous liquid deflection under the impact body and to the presence of the stem and the centering in the bore.

The orifice valve realized with the impact plate head is designed such that it exhibits a sealing washer or a sealing cone at the back side of the head which closes the valve seat at or, respectively, in the opening of the central bore of the ultrasonic oscillator. Given this inventive improvement, the retaining wire provided for the impact plate is held axially displaceable at its opposite end so that the lower surface or edge of the impact plate facing the atomizer surface can be pulled against the surface of the atomizer plate. In particular, this end of the retaining wire at which the pulling force for closing the orifice valve is exerted is held in a closing piece which is connected to the socket piece of the liquid atomizer, preferably over a hose piece which has sufficient elasticity for axial relative movement between the atomizer and the closing piece, so that this relative motion corresponds to the opening stroke required for the orifice valve.

DESCRIPTION OF THE PREFERRED EMBODIMENTS

Figure 1:
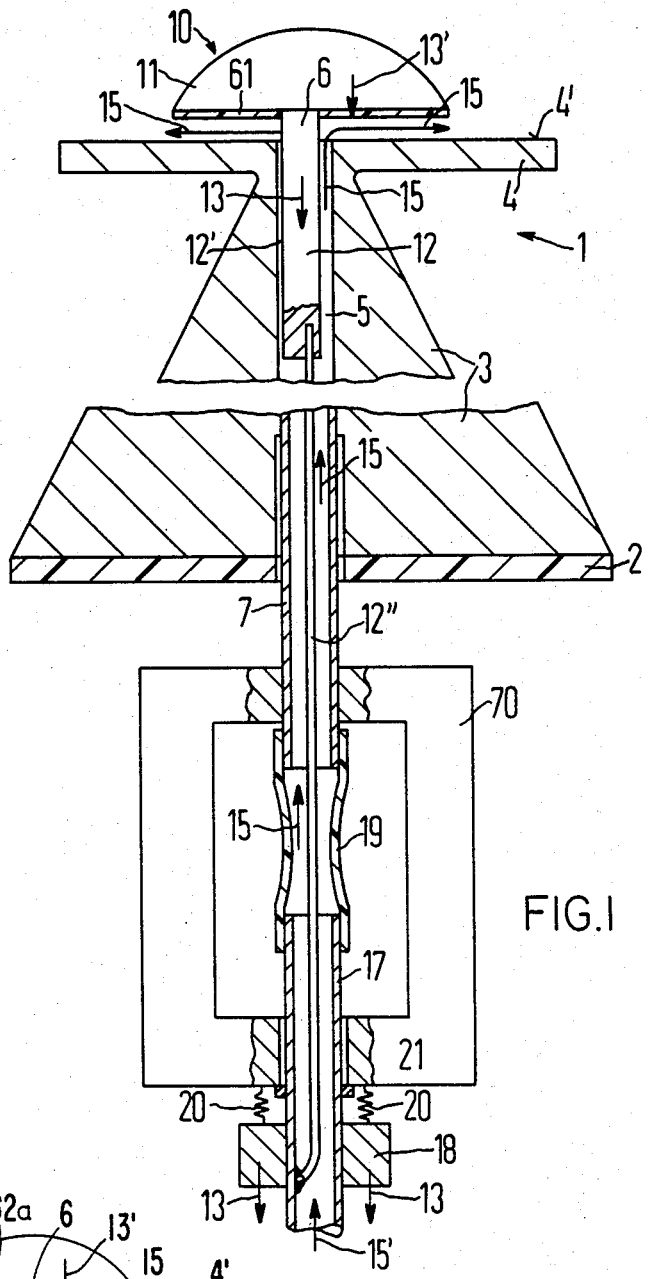
FIG. 1 illustrates a partial sectional view of an orifice valve according to the invention.

FIG. 1 illustrates a partially broken, sectional view of the orifice valve of the invention. 1 refers to the ultrasonic liquid atomizer with its conically-shaped oscillator 3 and its work plate 4 as well as the piezo-ceramic material transducer 2 rigidly attached thereto. 5 indicates the axial bore in the oscillator 3 in which the stem 12 of the impact plate designed as a mushroom cap 11 is situated. The stem 12 is displaceable in the bore 5 in an axial direction and has, for example, a triangular cross-section for the purpose of centering. The illustration of FIG. 1 is of such nature that the edge referenced 12' presses against the inside wall of the bore 5. Sufficient free cross-sectional surface remains along the stem 12 for the flow (referenced 15) of the liquid to be atomized and which is to be supplied to the surface 4' of the atomizer plate 4. The discharge opening of the bore 5 of the oscillator 3 is indicated at 6.

A sealing washer 61 is provided at the underside of the mushroom-shaped head 11. Given an axial reciprocation of the stem 12 with head 11 corresponding to the arrow 13, the spacing between the underside of the sealing washer 61 and the surface 4' of the plate 4 referenced 13' can be reduced to zero, i.e. the orifice valve can be closed. During the atomization mode (by applying a corresponding electrical excitation voltage to the transducer disk 2), the head 11 is placed in the position illustrated in the Figure with a corresponding spacing 13' which allows the liquid 15 to proceed to the surface 4' of the atomizer plate 4 not covered by the head 11.

A socket piece attached to the oscillator 3 is referenced 7.

The oscillator 3, and thus the liquid atomizer 1, is connected with the socket piece 7 to a mounting element or retaining part 70 which is built into a respective device in which the liquid atomizer 1 is situated. As illustrated, the tube 17 is guided in sliding fashion in the mounting element 70 and can be moved in the direction of the arrows 13, for which purpose, for example, appropriate force is applied to the flange rigidly connected to the tube 17 and referenced 18. This movement 13 is the same movement as already described in conjunction with the description of the atomizer 1. An elastic hose consisting, for example, of a plastic material is referenced 19, this allowing for a variation of length corresponding to the movement 13 or, respectively, to the stroke 13'.

A retaining wire 12'' extends inside the bore 5 of the socket piece 7 and of the tube 17, extending away from the lower end of the centered stem 12 of the head 11. It is secured both to the end of the stem 12 as well as to a location on the tube 17. Given the relative motion between the tube 17 and the socket piece 7 corresponding to the pulling direction 13, the stem 12, and thus the head 11, are drawn down against the surface 4' of the atomizer plate 4 in such manner that the aforementioned seal of the orifice valve results.

15' indicates the liquid supply into the tube 17, namely the liquid which then proceeds to the surface 4' as the liquid stream 15.

In the above, the kinematics have been described in conjunction with a pulling force. If the retaining wire 12' exhibits corresponding stiffness, the kinematics can also be operated with a force in a direction opposite arrow 13. The orifice valve is then closed in its idle state and is correspondingly opened by this force. 20 indicates springs which, depending upon the kinematics selected, are tension or compression springs.

The ring 21 rigidly connected to the tube 17 indicates a detent which determines the maximum orifice opening 13'.

Figure 2:
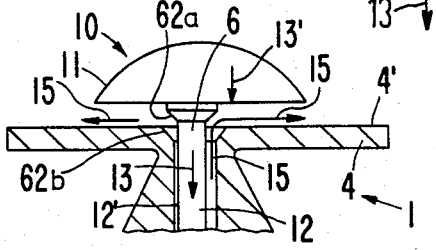
FIG. 2 illustrates an alternate embodiment of the valve of FIG. 1.

In place of sealing washer 61, in an alternate embodiment of the invention as shown in FIG. 2 a sealing cone assembly *62a, 62b* can be provided at the atomizer plate 4.

Although various changes and modifications might be proposed by those skilled in the art, it will be understood that I wish to include within the claims of the patent warranted hereon all such changes and modifications as reasonably come within my contribution to the art.

I claim as my invention:

1. An ultrasonic liquid atomizer with an orifice valve, comprising: an ultrasonic oscillator having an atomizer plate; axial bore means in the oscillator and atomizer plate for liquid supply onto a surface of the atomizer plate; impact body means for deflecting and distributing supplied liquid on the atomizer plate; the impact body means having a stem which is situated in the axial bore means of the oscillator and of the atomizer plate, the impact body means being approximately centered over said bore means; the stem of the impact body means being continued in the form of a retaining element extending through the axial bore means beyond the oscillator through a liquid supply tube connected to the axial bore means at a side opposite the atomizer plate; an end of the retaining element opposite the stem being secured to a component means for executing a motion of the impact body means relative to the atomizer plate such that an orifice opening at the surface of the atomizer plate between the atomizer plate and impact body means can be selectively closed when desired via the retaining element and the stem of the impact body means; said component means comprising a tube which is guided in sliding fashion on a retaining or mounting element of the liquid atomizer; and the tube being connected to a socket piece of the liquid atomizer via an elastic hose part such that a liquid line feed-through is formed.

2. An atomizer according to claim 1 wherein a sealing washer is provided at an underside of a head of the impact body means.

3. An atomizer according to claim 1 wherein a sealing cone is provided at an underside of a head of the impact body means.

4. An ultrasonic liquid atomizer, comprising: an ultrasonic oscillator formed of a body having a piezoelectric transducer attached therewith and wherein a portion of the body is formed as an atomizer plate; axial bore means in the body of the oscillator and atomizer plate for liquid supply onto a surface of the atomizer plate; impact body means for deflecting and distributing supplied liquid on the atomizer plate, said impact body means being approximately centered over said axial bore means; stem means attached to the impact body means and passing through the axial bore means; tube means for supplying liquid through the axial bore means; means for transmitting a reciprocating motion to said impact body means via the stem means passing through the axial bore means; an orifice opening formed at the surface of the atomizer plate between the atomizer plate and impact body means being openable and closable via the stem means by said reciprocating motion; and the tube means comprising first and second tube portions, the first tube portion having the stem means connected therewith and being movable, and wherein an elastic hose part means connects the first and second tube portions, the second tube portion being stationary.

5. An ultrasonic liquid atomizer with an orifice valve, comprising: an ultrasonic oscillator having an atomizer plate; axial bore means in the oscillator and atomizer plate for liquid supply onto a surface of the atomizer plate; impact body means for deflecting and distributing supplied liquid on the atomizer plate; the impact body means having a stem which is situated in the axial bore means of the oscillator and of the atomizer plate, the impact body means being approximately centered over said bore means; the stem of the impact body means being continued in the form of a retaining wire extending beyond the oscillator at a side opposite the atomizer plate; a tube means for supplying liquid to the axial bore means, said tube means comprising first and second tube portions, the first portion having the retaining wire attached therewith and being movable, and wherein an elastic hose part means connects the first and second tube portions, the second tube portion being stationary; whereby when the first tube portion is moved a motion of the impact body means is executed relative to the atomizer plate such that an orifice opening at the surface of the atomizer plate between the atomizer plate and impact body means can be closed via the retaining wire and the stem of the impact body means.

6. An atomizer with orifice valve according to claim 5 wherein a sealing washer is provided at an underside of a head of the impact body means.

7. An atomizer with an orifice valve according to claim 5 wherein at a location where the elastic hose part means connects the first and second tube portions a retaining part is provided which surrounds the hose part means, said retaining part being in fixed connection with the second tube portion and slidably receiving the first tube portion.

* * * * *